US011821169B2

(12) United States Patent
Peterson et al.

(10) Patent No.: US 11,821,169 B2
(45) Date of Patent: Nov. 21, 2023

(54) SYSTEM AND METHOD FOR CONTROLLING IMPLEMENT ORIENTATION OF A WORK VEHICLE BASED ON A MODIFIED ERROR VALUE

(71) Applicant: CNH Industrial America LLC, New Holland, PA (US)

(72) Inventors: Caleb Peterson, Fargo, ND (US); Eric John Williams, Fargo, ND (US); Mitchell M. Johnson, Fargo, ND (US); Duqiang Wu, Bolingbrook, IL (US)

(73) Assignee: CNH Industrial America LLC, New Holland, PA (US)

( * ) Notice: Subject to any disclaimer, the term of this patent is extended or adjusted under 35 U.S.C. 154(b) by 351 days.

(21) Appl. No.: 17/162,454

(22) Filed: Jan. 29, 2021

(65) Prior Publication Data

US 2022/0243425 A1 Aug. 4, 2022

(51) Int. Cl.

| | |
|---|---|
| ***E02F 9/20*** | (2006.01) |
| ***E02F 3/43*** | (2006.01) |
| ***E02F 9/26*** | (2006.01) |

(52) U.S. Cl.

CPC ..... *E02F 9/2041* (2013.01); *E02F 3/432* (2013.01); *E02F 3/434* (2013.01); *E02F 9/2029* (2013.01); *E02F 9/265* (2013.01)

(58) Field of Classification Search

CPC ..... E02F 9/2041; E02F 3/432; E02F 3/434; E02F 9/2029; E02F 9/265

See application file for complete search history.

(56) References Cited

U.S. PATENT DOCUMENTS

| | | | |
|---|---|---|---|
| 8,340,875 | B1 | 12/2012 | Shatters et al. |
| 9,234,329 | B2 | 1/2016 | Jaliwala et al. |
| 9,464,410 | B2 | 10/2016 | Johnson et al. |
| 9,822,507 | B2 | 11/2017 | Singh et al. |
| 10,017,912 | B2 | 7/2018 | Singh et al. |

(Continued)

OTHER PUBLICATIONS

Ellen Yi Chen, "Controls and Signals", Jan. 5, 2011, Maslab IAP 2011 (Year: 2011).*

(Continued)

*Primary Examiner* — James J Lee
*Assistant Examiner* — Clint Pham
(74) *Attorney, Agent, or Firm* — Rickard DeMille; Rebecca Henkel

(57) ABSTRACT

A system for controlling implement orientation of a work vehicle includes a computing system configured to control an operation of a lift actuator of the vehicle such that an implement of the vehicle is moved from a first vertical position relative to a second vertical position. Furthermore, the computing system is configured to monitor the angle of the implement as the implement is moved from the first vertical position to the second vertical position. Additionally, the computing system is configured to determine an actual error value between the monitored angle and a selected angle of the implement. Moreover, the computing system is configured to determine a modified error value that is different than the actual error value and control an operation of a tilt actuator of the vehicle to adjust the angle of the implement relative to the driving surface based on the modified error value.

18 Claims, 4 Drawing Sheets

(56) References Cited

U.S. PATENT DOCUMENTS

2011/0301781 A1* 12/2011 Karlsson ..... E02F 9/26
701/1
2019/0135599 A1* 5/2019 Myers ..... B66F 9/22

OTHER PUBLICATIONS

MATLAB® 9.2, "Introduction: PID Controller Design" (Year: 2017).*
Tore Hagglund, "Signal Filtering in PID Control", Department of Automatic Control, Lund University, 2nd IFAC Conference on Advances in PID Control (Year: 2012).*

* cited by examiner

SYSTEM AND METHOD FOR CONTROLLING IMPLEMENT ORIENTATION OF A WORK VEHICLE BASED ON A MODIFIED ERROR VALUE

FIELD OF THE INVENTION

The present disclosure generally relates to work vehicles and, more particularly, to systems and methods for controlling implement orientation of a work vehicle based on a modified error value.

BACKGROUND OF THE INVENTION

Work vehicles having loader arms, such as wheel loaders, skid steer loaders, backhoe loaders, compact track loaders, and the like, are a mainstay of construction work and industry. For example, wheel loaders typically include a pair of loader arms pivotably coupled to the vehicle's chassis that can be raised and lowered at the operator's command. As such, wheel loaders may include one or more hydraulic cylinders to raise and lower the loader arms. Moreover, the loader arms typically have an implement attached to their end, thereby allowing the implement to be moved relative to the ground as the loader arms are raised and lowered. For example, a bucket is often coupled to the loader arms, which allows the wheel loader to be used to carry supplies or particulate matter, such as gravel, sand, or dirt, around a worksite.

When moving an implement containing supplies or particulate matter from a first position (e.g., a digging position) to a second position (e.g., a dumping position), the implement must be tilted upward slightly to prevent the supplies/particulate from falling out of the bucket. That is, the implement must be tilted such that its forward end is slightly higher relative to the driving surface than its rear end. However, due to the geometry/kinematics of the various components (e.g., the loader arms, the hydraulic cylinders, and the associated pivot joints) that couple the implement to the vehicle frame, the orientation of the implement relative to the loader arms must be adjusted when raising and lowering the implement to maintain the desired angle between the implement and the driving surface.

As such, systems have been developed to adjust the orientation of the implement relative to the loader arms when raising and lowering the implement. While such systems work well, further improvements are needed. For example, in certain instances, such systems generally have slow response times, which may inhibit operation of the work vehicle.

Accordingly, an improved system and method for controlling implement orientation of a work vehicle would be welcomed in the technology.

SUMMARY OF THE INVENTION

Aspects and advantages of the technology will be set forth in part in the following description, or may be obvious from the description, or may be learned through practice of the technology.

In one aspect, the present subject matter is directed to a system for controlling implement orientation of a work vehicle. The system includes a vehicle chassis, a loader arm pivotably coupled to the vehicle chassis, and an implement pivotably coupled to the loader arm. Furthermore, the system includes a lift actuator coupled between the loader arm and the vehicle chassis, with the lift actuator configured to adjust a vertical position of the implement relative to a driving surface. Additionally, the system includes a tilt actuator coupled between the implement and the loader arm, with the tilt actuator configured to adjust an angle of the implement relative to the driving surface. Moreover, the system includes a sensor configured to capture data indicative of the angle of the implement and a computing system communicatively coupled to the sensor. The computing system is configured to control an operation of the lift actuator such that the implement is moved from a first vertical position relative to the driving surface to a second vertical position relative to the driving surface. In addition, the computing system is configured to monitor the angle of the implement based on the data captured by the sensor as the implement is moved from the first vertical position to the second vertical position. Furthermore, the computing system is configured to determine an actual error value between the monitored angle and a selected angle of the implement. Moreover, the computing system is configured to determine a modified error value that is different than the actual error value and control an operation of the tilt actuator to adjust the angle of the implement relative to the driving surface based on the modified error value.

In another aspect, the present subject matter is directed to a method for controlling implement orientation of a work vehicle. The work vehicle, in turn, includes a lift actuator configured to adjust a vertical position of an implement of the work vehicle relative to a driving surface. Furthermore, the work vehicle includes a tilt actuator configured to adjust an angle of the implement relative to the driving surface. In this respect, the method includes controlling, with a computing system, an operation of the lift actuator such that the implement is moved from a first vertical position relative to the driving surface to a second vertical position relative to the driving surface. Additionally, the method includes monitoring, with the computing system, the angle of the implement based on received sensor data as the implement is moved from the first vertical position to the second vertical position. Moreover, the method includes determining, with the computing system, an actual error value between the monitored angle and a selected angle of the implement. In addition, the method includes determining, with the computing system, a modified error value that is different than the actual error value. Furthermore, the method includes controlling, with the computing system, an operation of the tilt actuator to adjust the angle of the implement relative to the driving surface based on the modified error value.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
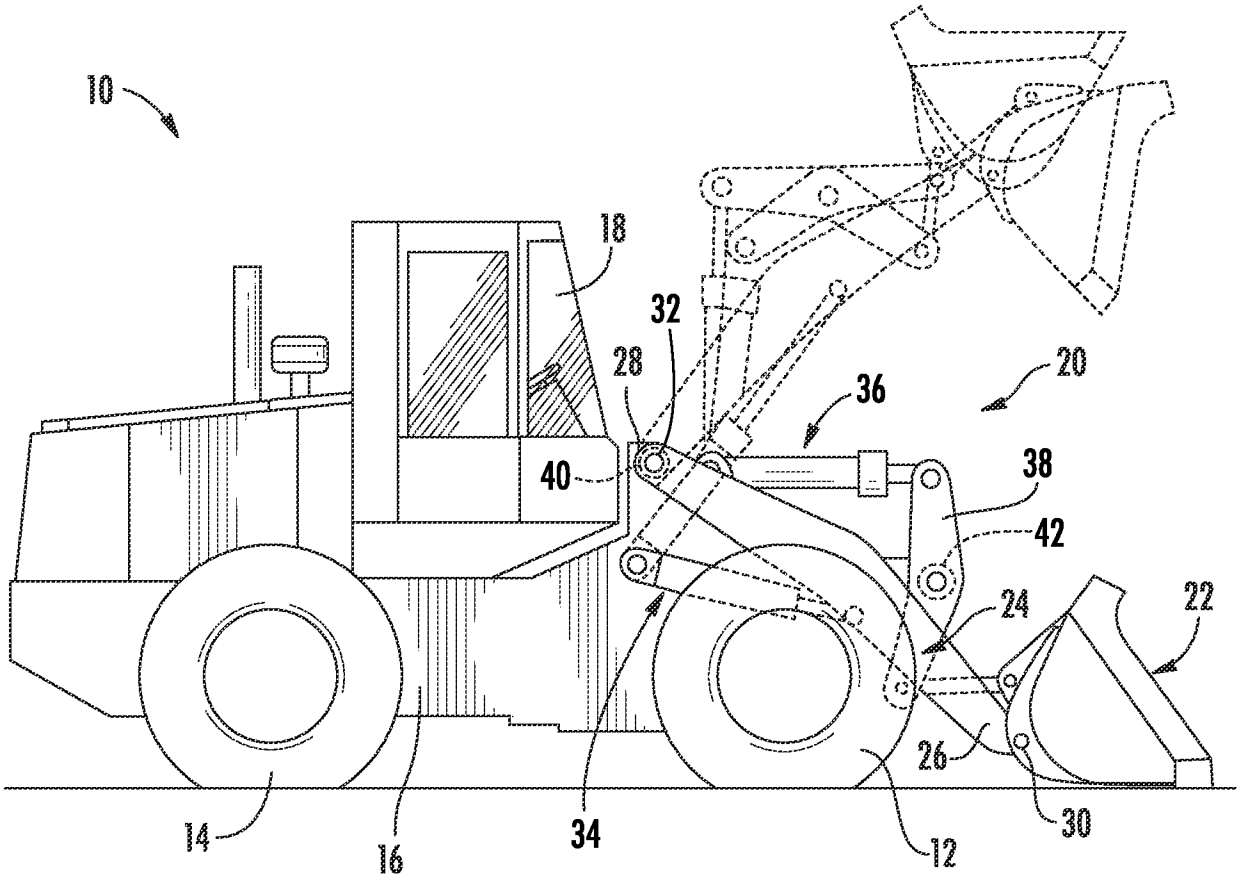
FIG. 1 illustrates a side view of one embodiment of a work vehicle in accordance with aspects of the present subject matter.

Repeat use of reference characters in the present specification and drawings is intended to represent the same or analogous features or elements of the present technology.

DETAILED DESCRIPTION OF THE DRAWINGS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to controlling the implement orientation of a work vehicle. As will be described below, the work vehicle may include a chassis, one or more loader arms pivotably coupled to the chassis, and an implement (e.g., a bucket) pivotably coupled to the loader arm(s). Moreover, the work vehicle may include one or more lift actuators (e.g., a hydraulic cylinder(s)) configured to adjust the vertical position of the implement relative to a driving surface. Additionally, the system may include one or more tilt actuators (e.g., a hydraulic cylinder(s)) configured to adjust the angle of the implement relative to the driving surface.

In accordance with aspects of the present subject matter, a computing system may be configured to control the angle of the implement as it is moved between first and second vertical positions. Specifically, in several embodiments, the computing system may control the operation of the lift actuator(s) such that the implement is moved from a first vertical position relative to the driving surface to a second vertical position relative to the driving surface (e.g., upon receipt of an operator input/command). As the implement is moved between the first and second vertical positions, the computing system may monitor the angle of the implement (e.g., relative to the loader arm(s)) based on received sensor data. In this respect, the computing system may determine an actual error value between the monitored angle and a selected angle of the implement. The selected angle may, in turn, be a preset or desired angle of the implement relative to the driving surface and may, e.g., be received from the operator. Moreover, the computing system may then determine a modified error value. In most instances, the magnitude of the modified error value is greater than the magnitude of the actual error value and may be determined based on the actual error value. Thereafter, the computing system may control the operation of the tilt actuator(s) to adjust the angle of the implement relative to the driving surface based on the modified error value.

Controlling the operation of the tilt actuator(s) based on the modified error value may provide one or more technical advantages. As mentioned above, many conventional systems for controlling the orientation of a work vehicle implement may, in certain instances, have slow response times. In this respect, by determining a modified error value that is greater than the actual error value, the disclosed system controls the tilt actuator(s) in a more responsive manner than conventional systems. Specifically, the use of the modified error value causes the computing system to operate as if the implement is farther from the selected angle than it actually is. Thus, the disclosed system controls the tilt actuator(s) in a manner that moves the implement toward the selected angle quicker than conventional systems using the actual error value.

Referring now to the drawings, FIG. 1 illustrates a side view of one embodiment of a work vehicle 10. As shown, the work vehicle 10 is configured as a wheel loader. However, in other embodiments, the work vehicle 10 may be configured as any other suitable work vehicle that includes a lift assembly for adjusting the position of an associated implement, such as a skid steer loader, a backhoe loader, a compact track loader and/or the like.

As shown in FIG. 1, the work vehicle 10 includes a pair of front wheels 12 (one of which is shown), a pair or rear wheels 14 (one of which is shown), and a frame or chassis 16 coupled to and supported by the wheels 12, 14. An operator's cab 18 may be supported by a portion of the chassis 16 and may house various control or input devices (e.g., levers, pedals, control panels, buttons and/or the like) for permitting an operator to control the operation of the work vehicle 10.

Moreover, as shown in FIG. 1, the work vehicle 10 may include a lift assembly 20 for raising and lowering a suitable implement 22 (e.g., a bucket) relative to a driving surface of the vehicle 10. In several embodiments, the lift assembly 20 may include a pair of loader arms 24 (one of which is shown) pivotably coupled between the chassis 16 and the implement 22. For example, as shown in FIG. 1, each loader arm 24 may include a forward end 26 and an aft end 28. As such, the forward ends 26 may be pivotably coupled to the implement 22 at forward pivot joints 30 and the aft ends 28 may be pivotally coupled to a portion of the chassis 16 at rear pivot joints 32.

In addition, the lift assembly 20 may also have one or more lift actuators 34 and one or more tilt actuators 36. Specifically, in several embodiments, the lift assembly 20 may include a pair of lift actuators 34 (e.g., hydraulic cylinders or electric linear actuators) coupled between the chassis 16 and the loader arms 24. Moreover, in such embodiments, the lift assembly 20 may include a tilt actuator 36 (e.g., a hydraulic cylinder or an electric linear actuator) coupled between the chassis 16 and the implement 22 (e.g., via a pivotably mounted bell crank 38 or other mechanical linkage). In this respect, the lift and tilt actuators 34, 36 may raise/lower and/or pivot the implement 22 relative to the driving surface of the work vehicle 10. Specifically, the lift actuators 34 may be extended and retracted to pivot the loader arms 24 upward and downward, respectively, thereby controlling the vertical positioning of the implement 22 relative to the driving surface. For instance, as shown in FIG. 1, the operation of the lift actuators 34 may be controlled to move the loader arms 24 between a lowered position (indicated in solid lines), such as a return-to-digposition or a return-to-travel position, and a raised position (indicated in dashed lines), such as a return-to-height position or a return-to-dump position. Additionally, the tilt actuators 36 may be extended and retracted to pivot the implement 22 relative to the loader arms 24 about the forward pivot point 30, thereby controlling the tilt angle or orientation of the implement 22 relative to the driving surface.

Furthermore, in several embodiments, the work vehicle 10 may include a lift position sensor 40. In general, the lift position sensor 40 may be configured to capture data indicative of the angle or orientation of the loader arms 24 relative to the chassis 16. For example, in such an embodiment, the lift position sensor 40 may correspond to a potentiometer positioned between the loader arms 24 and the chassis 16, such as within one of the rear pivot joints 32. In this respect, as the loader arms 24 and the implement 22 are raised and lowered relative to the ground, the voltage output by the lift position sensor 40 may vary, with such voltage being indicative of the angle of the loader arms 24 relative to the chassis 16. This angle may, in turn, be indicative of the vertical position of the implement 22 relative to the driving surface. However, in other embodiments, the lift position sensor 40 may correspond to any other suitable sensor(s) and/or sensing device(s) configured to capture data associated with the vertical position of the implement 22 relative to the driving surface.

Moreover, in some embodiments, the work vehicle 10 may include a tilt position sensor 42. In general, the tilt position sensor 42 may be configured to capture data indicative of the angle or orientation of the implement 22 relative to the driving surface. For example, in one embodiment, the tilt position sensor 42 may correspond to a potentiometer positioned within or otherwise provided in operative association with a pivot joint 42 about which the bell crank 38 rotates. In this respect, as the implement 22 is pivoted relative to the loader arms 24, the voltage output by the tilt position sensor 42 may vary, with such voltage being indicative of the angle or orientation of the implement 22 relative to the driving surface. However, in other embodiments, the tilt position sensor 42 may correspond to any other suitable sensor(s) and/or sensing device(s) configured to capture data associated with the angle or orientation of the implement 22 relative to the driving surface. For example, in one embodiment, the tilt position sensor 42 may be positioned within or otherwise provided in operative association with one of the pivot joints 30.

It should be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration. For example, the work vehicle 10 was described above as including a pair of lift actuators 34 and a pair of tilt actuators 36. However, in other embodiments, the work vehicle 10 may, instead, include any number of lift actuators 38 and/or tilt actuators 36, such as by only including a single lift actuator 34 for controlling the movement of the loader arms 24 and/or a plurality of tilt actuators 36 for controlling the movement of the implement 22.

Figure 2:
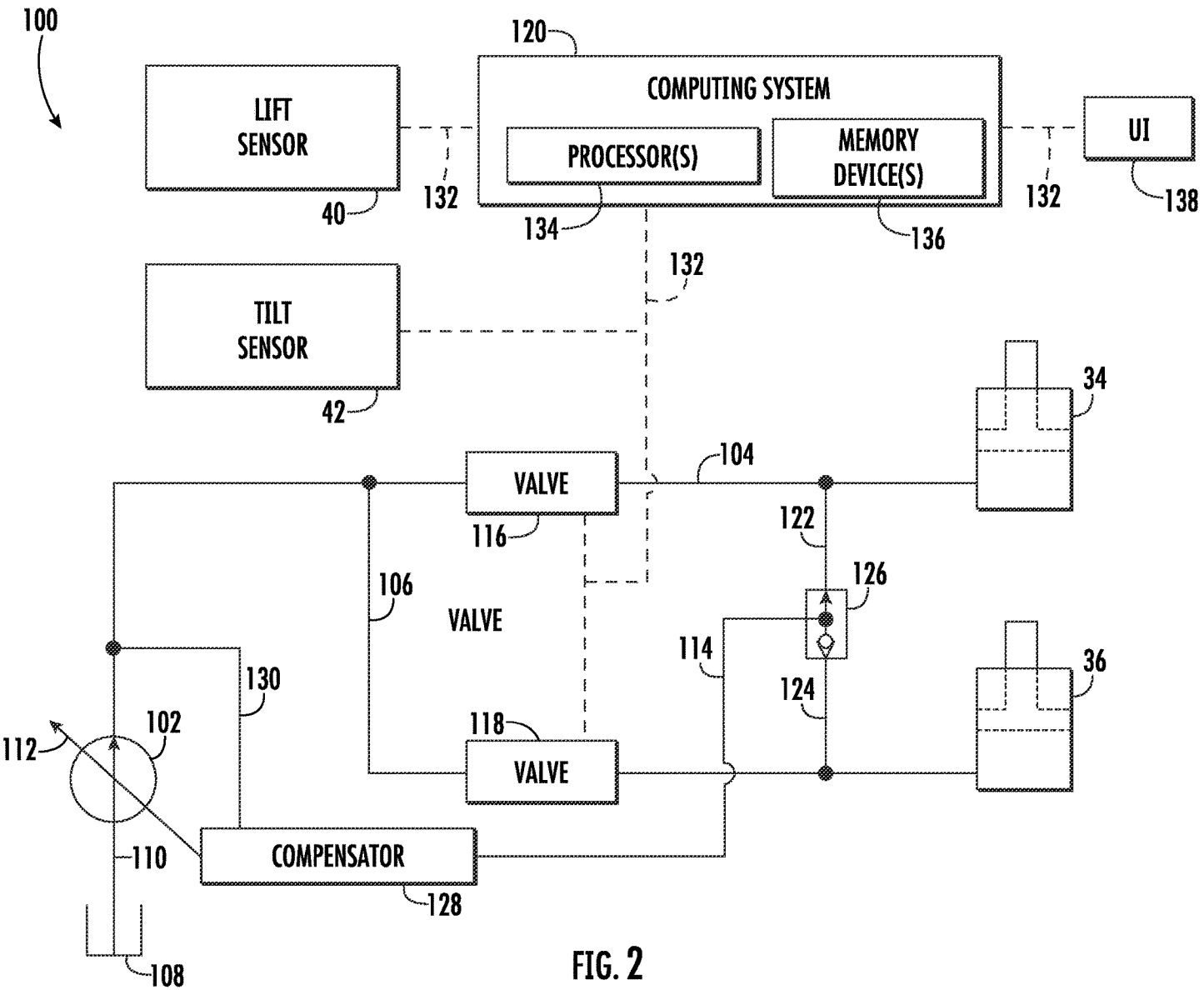
FIG. 2 illustrates a schematic view of one embodiment of a system for controlling implement orientation of a work vehicle in accordance with aspects of the present subject matter.

Referring now to FIG. 2, a schematic view of one embodiment of a system 100 for controlling the implement orientation of a work vehicle is illustrated in accordance with aspects of the present subject matter. In general, the system 100 will be described herein with reference to the work vehicle 10 described above with reference to FIG. 1. However, it should be appreciated by those of ordinary skill in the art that the disclosed system 100 may generally be utilized with work vehicles having any other suitable vehicle configuration. It should also be appreciated that, for purposes of illustration, hydraulic connections between components of the system 100 are shown in solid lines while electrical connection between components of the system 100 are shown in dashed lines.

In several embodiments, as shown in FIG. 2, the system 100 may include one or more actuators of the work vehicle 10. In this respect, as will be described below, the system 100 may be configured to regulate or otherwise control the hydraulic fluid flow within the work vehicle 10 such that the hydraulic fluid is supplied to the actuator(s) of the vehicle 10 in a manner that the vertical position and the angle/orientation of the implement 22 to be adjusted relative to the driving surface. For example, in the illustrated embodiment, the system 100 includes the lift actuators 34 and the tilt actuators 36 of the work vehicle 10. However, in alternative embodiments, the system 100 may include any other suitable hydraulic actuators of the work vehicle 10 in addition to or lieu of the lift and tilt actuators 34, 36. Additionally, in some embodiments, the system 100 may include one or more electric actuators in addition to or lieu of the hydraulic actuators.

As shown in FIG. 2, the system 100 may include a pump 102 configured to supply hydraulic fluid to the hydraulic load (s) of the vehicle 10. Specifically, in several embodiments, the pump 102 may be configured to supply hydraulic fluid to the lift actuators 34 of the vehicle 10 via a first fluid supply conduit 104 and the tilt actuators 36 of the vehicle 10 via a second fluid supply conduit 106. However, in alternative embodiments, the pump 102 may be configured to supply hydraulic fluid to any other suitable hydraulic actuators of the vehicle 10. Additionally, the pump 102 may be in fluid communication with a fluid tank or reservoir 108 via a pump conduit 110 to allow hydraulic fluid stored within the reservoir 108 to be pressurized and supplied to the lift and tilt actuators 34, 36.

In several embodiments, the pump 102 may be a variable displacement pump configured to discharge hydraulic fluid across a given pressure range. Specifically, the pump 102 may supply pressurized hydraulic fluid within a range bounded by a minimum pressure and a maximum pressure capability of the variable displacement pump. In this respect, a swash plate 112 may be configured to be controlled mechanically via a load sense conduit 114 to adjust the position of the swash plate 112 of the pump 102, as necessary, based on the load applied to the hydraulic system of the vehicle 10. However, in other embodiments, the pump 102 may correspond to any other suitable pressurized fluid source. Moreover, the operation of the pump 102 may be controlled in any other suitable manner, such as by an electronically controlled actuator (e.g., a solenoid).

Furthermore, the system 100 may include one or more flow control valves. In general, the flow control valve(s) may be fluidly coupled to a fluid supply conduit(s) upstream of the corresponding hydraulic actuator such that the flow control valve(s) is configured to control the flow rate of the hydraulic fluid to the actuator(s). Specifically, in several embodiments, the system 100 may include a first flow control valve 116 fluidly coupled to the first fluid supply conduit 104 upstream of the lift actuators 34. The first flow control valve 116 may, in turn, define an adjustable orifice (not shown). In this respect, by adjusting the cross-sectional area of the orifice, the first flow control valve 116 is able to control the flow rate of the hydraulic fluid to the lift actuators 34 and, thus, the movement of the loader arms 24 relative to the vehicle frame 16. Moreover, in such embodiments, the system 100 may include a second flow control valve 118 fluidly coupled to the second fluid supply conduit 106 upstream of the tilt actuators 36. The second flow control valve 118 may, in turn, define an adjustable orifice. As such, by adjusting the cross-sectional area of the orifice, the second flow control valve 118 is able to control the flow rate of the hydraulic fluid to the tilt actuators 36 and, thus, the movement of the implement 22 relative to the loader arms 24.

The first and second flow control valves 116, 118 may be configured as any suitable valves defining adjustable orifices. For example, in one embodiment, first and second flow control valves 116, 118 may be proportional directional valves. Such valves 116, 118 may include actuators (e.g., solenoid actuators) configured to adjust the cross-sectional areas of the orifices in response to receiving control signals, such as from a computing system 120.

Additionally, as indicated above, the system 100 may include a load sense conduit 114. In general, the load sense conduit 114 may receive hydraulic fluid bled from the first or second fluid supply conduit 104, 106 having the greater pressure therein. More specifically, the system 100 may include a first bleed conduit 122 fluidly coupled to the first fluid supply conduit 104 downstream of the first flow control valve 116. Furthermore, the system 100 may include a second bleed conduit 124 fluidly coupled to the second fluid supply conduit 106 downstream of the second flow control valve 118. Thus, the first bleed conduit 122 may receive hydraulic fluid bled from the first fluid supply conduit 104 and the second bleed conduit 124 may receive hydraulic fluid bled from the second fluid supply conduit 106. Furthermore, the system 100 may include a shuttle valve 126 fluidly coupled to the first and second bleed conduits 122, 124 and the load sense conduit 114. The shuttle valve 126 may, in turn, be configured to supply hydraulic fluid from the first or second bleed conduit 122, 124 having the greater pressure therein to the load sense conduit 114. In this respect, the hydraulic fluid supplied to the load sense conduit 114 may have the same pressure as the fluid supply conduit 104, 106 having the greater pressures therein.

The hydraulic fluid within the load sense conduit 114 may be indicative of the load on the hydraulic system of the vehicle 10 and, thus, may be used to control the operation of the pump 102. More specifically, the load sense conduit 114 may supply the hydraulic fluid therein to a pump compensator 128. The pump compensator 128 may also receive hydraulic fluid bled from the first and/or second fluid supply conduits 104, 106 upstream of the flow control valves 116, 118 via a bleed conduit 130. Additionally, the pump compensator 128 may have an associated a pump margin. In this respect, the pump compensator 128 may control the operation of the pump 102 such that the pump 102 discharges hydraulic fluid at a pressure that is equal to the sum of the pump margin and the pressure of the hydraulic fluid received from the load sense conduit 114.

In this illustrated embodiment, the pump compensator 128 corresponds to a mechanical device. For instance, the pump compensator 128 may correspond to a passive hydraulic cylinder coupled to the swash plate 112 of the pump 102. In such an embodiment, hydraulic fluid from the load sense conduit 114 is supplied to one chamber of the cylinder and hydraulic fluid from a bleed conduit 130 is supplied to the other chamber of the cylinder. Moreover, the pump compensator 128 may include a biasing element, such as a spring, in association within the cylinder to set the pump margin. In this respect, when the sum of the pressure received from the load sense conduit 114 and the pump margin exceeds the pressure within the bleed conduit 130, the pump compensator 128 may move the swash plate 112 to increase the pressure of the hydraulic fluid discharged by the pump 102. Conversely, when the sum of the pressure received from the load sense conduit 114 and the pump margin falls below the pressure within the bleed conduit 130, the pump compensator 128 may move the swashplate 112 to decrease the pressure of the hydraulic fluid discharged by the pump 102. However, as will be described below, in other embodiments, the pump compensator 128 may be configured as any other suitable device for controlling the operation of the pump 102.

In accordance with aspects of the present subject matter, the system 100 may include a computing system 120 communicatively coupled to one or more components of the work vehicle 10 and/or the system 100 to allow the operation of such components to be electronically or automatically controlled by the computing system 120. For instance, the computing system 120 may be communicatively coupled to the first flow control valve 116 via a communicative link 132. As such, the computing system 120 may be configured to control the operation of the lift actuators 34 raise and lower the loader arms 24 relative to the driving surface. Furthermore, the computing system 120 may be communicatively coupled to the second flow control valve 118 via the communicative link 132. In this respect, the computing system 120 may be configured to control the operation of the valve 118 to regulate the flow of the hydraulic fluid to the tilt actuators 36 such that the tilt actuators 36 adjust the angle or tilt of the implement 22 relative to the loader arms 24 and, thus, the driving surface. Moreover, the computing system 120 may be communicatively coupled to the lift and tilt position sensors 40, 42 via the communicative link 132. Thus, the computing system 120 may be configured to receive data from these sensors 40, 42 indicative of the position of the implement 22, namely the vertical position of the implement 22 relative to the driving surface and the angle or orientation of the implement 22 relative to the driving surface.

In general, the computing system 120 may comprise one or more processor-based devices, such as a given controller or computing device or any suitable combination of controllers or computing devices. Thus, in several embodiments, the computing system 120 may include one or more processor(s) 134 and associated memory device(s) 136 configured to perform a variety of computer-implemented functions. As used herein, the term "processor" refers not only to integrated circuits referred to in the art as being included in a computer, but also refers to a controller, a microcontroller, a microcomputer, a programmable logic circuit (PLC), an application specific integrated circuit, and other programmable circuits. Additionally, the memory device(s) 136 of the computing system 120 may generally comprise memory element(s) including, but not limited to, a computer readable medium (e.g., random access memory RAM)), a computer readable non-volatile medium (e.g., a flash memory), a floppy disk, a compact disk-read only memory (CD-ROM), a magneto-optical disk (MOD), a digital versatile disk (DVD) and/or other suitable memory elements. Such memory device(s) 136 may generally be configured to store suitable computer-readable instructions that, when implemented by the processor(s) 134, configure the computing system 120 to perform various computer-implemented functions, such as one or more aspects of the methods and algorithms that will be described herein. In addition, the computing system 120 may also include various other suitable components, such as a communications circuit or module, one or more input/output channels, a data/control bus and/or the like.

The various functions of the computing system 120 may be performed by a single processor-based device or may be distributed across any number of processor-based devices, in which instance such devices may be considered to form part of the computing system 120. For instance, the functions of the computing system 120 may be distributed across multiple application-specific controllers or computing devices, such as an implement controller, a navigation controller, an engine controller, and/or the like.

Furthermore, in some embodiment, the system 100 may also include a user interface 138. More specifically, the user interface 138 may be configured to receive inputs (e.g., inputs associated with raising and lowering the implement 22 and/or a selected angle for the implement 22) from the operator. As such, the user interface 138 may include one or more input devices, such as touchscreens, keypads, touchpads, knobs, buttons, sliders, switches, mice, microphones, and/or the like, which are configured to receive user inputs from the operator. For example, in one embodiment, the user interface 138 may include one joystick(s) (not shown) within the cab 18 of the vehicle 10. The user interface 138 may, in turn, be communicatively coupled to the computing system 120 via the communicative link 132 to permit the received inputs to be transmitted from the user interface 138 to the computing system 120. In addition, some embodiments of the user interface 138 may include one or more feedback devices (not shown), such as display screens, speakers, warning lights, and/or the like, which are configured to provide feedback from the computing system 120 to the operator. In one embodiment, the user interface 138 may be mounted or otherwise positioned within the cab 18 of the vehicle 10. However, in alternative embodiments, the user interface 138 may mounted at any other suitable location.

Figure 3:
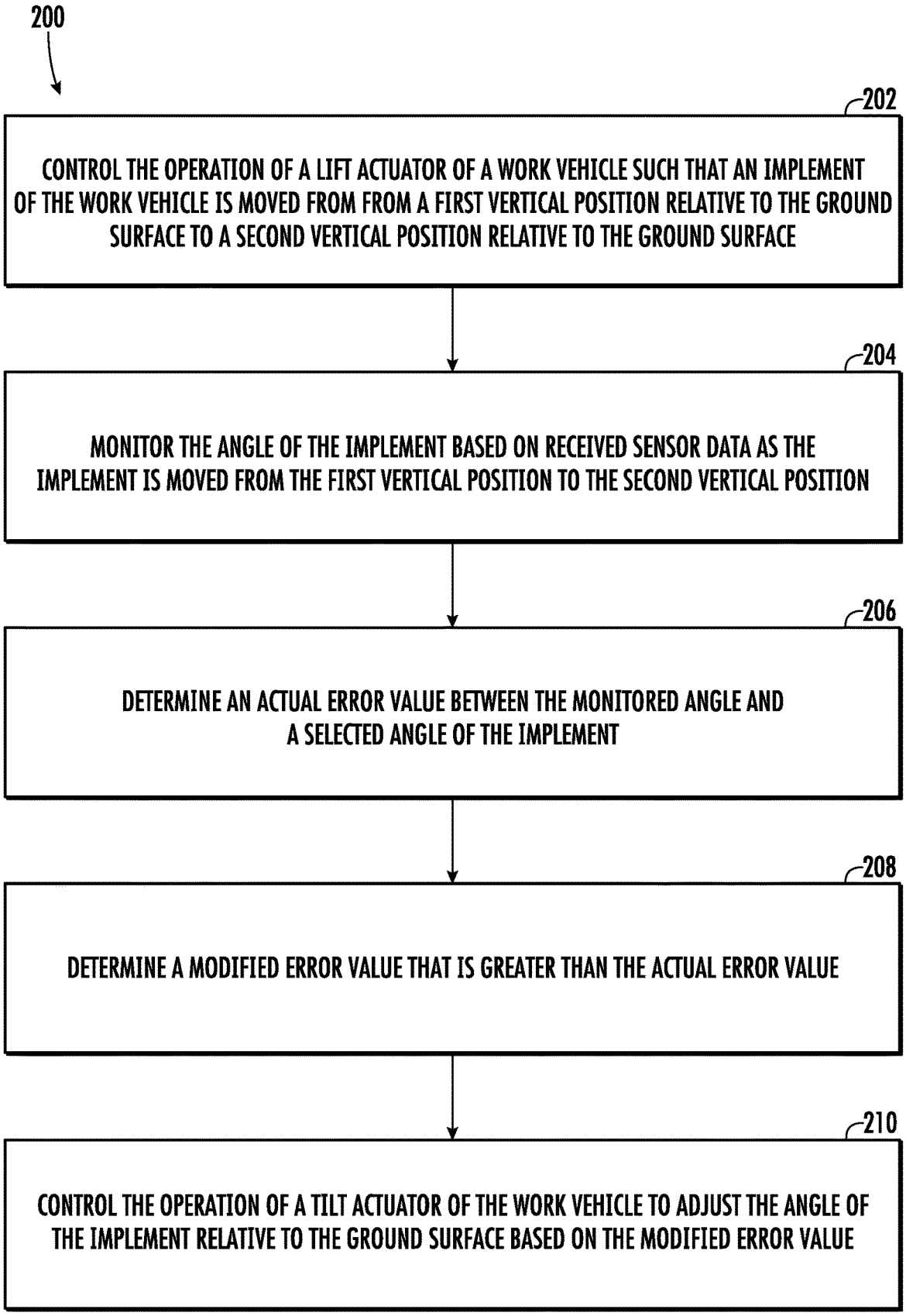
FIG. 3 illustrates a flow diagram of one embodiment of a method for controlling implement orientation of a work vehicle in accordance with aspects of the present subject matter.

Referring now to FIG. 3, a flow diagram of one embodiment of a method 200 for controlling the implement orientation of a work vehicle is illustrated in accordance with aspects of the present subject matter. In general, the method 200 will be described herein with reference to the work vehicle 10 and the system 100 described above with reference to FIGS. 1 and 2. However, it should be appreciated by those of ordinary skill in the art that the disclosed method 200 may generally be implemented with any work vehicle having any suitable vehicle configuration and/or within any system having any suitable system configuration. In addition, although FIG. 3 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 3, at (202), the method 200 may include controlling, with a computing system, the operation of a lift actuator of a work vehicle such that an implement of the work vehicle is moved from a first vertical position relative to the driving surface to a second vertical position relative to the driving surface. In several embodiments, when the operator would like to raise or lower the implement 22 relative to the driving surface, he/she may provide an input to the user interface 138 associated with a selected or target position. The input from the operator may then be transmitted from the user interface 138 to the computing system 120 via the communicative link 132. Thereafter, the computing system 120 may control the operation of the valve 116 (e.g., based on data received from the lift sensor 40) such that the lift actuators 34 raise or lower the implement 22 relative to the driving surface from its current position to the selected/target position.

Additionally, at (204), the method 200 may include monitoring, with the computing system, the angle of the implement based on received sensor data as the implement is moved from the first vertical position to the second vertical position. In several embodiments, as the lift actuators 34 raise or lower the implement 22, the computing system 120 may receive data associated with the current angle of the implement 22 relative to the driving surface from the tilt position sensor 42 (e.g., via the communicative link 132). In this respect, the computing system 120 may be configured to process or analyze the data received from the sensor 42 to determine or estimate the current angle of the implement 22 relative to the driving surface. For instance, the computing system 120 may include a look-up table(s), suitable mathematical formula, and/or an algorithm(s) stored within its memory device(s) 136 that correlates the received sensor data to the corresponding implement angle/orientation.

Moreover, as shown in FIG. 3, at (206), the method 200 may include determining, with the computing system, an actual error value between the monitored angle and a selected angle of the implement. More specifically, in several embodiments, the computing system 120 may compare the monitored angle values of the implement 22 determined at (204) to a selected or predetermined angle for the implement 22 to determine an actual error value. The computing system 120 may determine an actual error value for each angle measurement at (204). As will be described below, a modified error value may be determined based on the actual error value and used to control the tilt actuators 36 to improve the responsiveness of the system 100.

In some embodiments, the selected angle for the implement 22 may be an angle defined by the implement 22 and the driving surface that prevents material within or on the implement 22 from falling out or off of the implement 22 when the implement 22 is raised or lowered. For example, the selected angle may generally be an angle at which the implement is tilted slightly back such that its forward end is at a higher vertical position than its rear end.

The computing system 120 may receive the selected angle(s) in any suitable manner. For example, in several embodiments, the operator of the work vehicle 10 may provide an input to the user interface 138 associated with the selected angle(s) the implement 22. The input from the operator may then be transmitted from the user interface 138 to the computing system 120 via the communicative link 132. Alternatively, the selected angle(s) may be stored within memory device(s) 136 of the computing system 120.

Furthermore, at (208), the method 200 may include determining, with the computing system, a modified error value that is different than the actual error value. More specifically, in several embodiments, the computing system 120 may be configured to determine a modified error value. As will be described below, the computing system 120 may use the modified error value to control the angle of the implement 22 as the implement 22 is raised or lowered. In general, the modified error value is greater than the actual error value. As such, when using the modified error value as opposed to the actual error value, the computing system 120 operates as if the implement 22 is farther from the selected angle than it actually is. In this respect, the computing system 120 controls the tilt actuator(s) 36 in a manner that more quickly moves the implement 22 toward the selected angle than conventional systems using the actual error value.

At (208), the computing system 120 may determine the modified error value, which is greater than the actual error value, in any suitable manner. For example, in some embodiments, the computing system 120 may determine a modifier value for the actual error value. For example, the computing system 120 may include a look-up table(s), suitable mathematical formula, and/or an algorithm(s) stored within its memory device(s) 136 that correlates the actual error value to the corresponding modifier value. Thereafter, in such embodiments, the computing system 120 may apply the determined modifier value to the actual error value (e.g., by multiplying the actual error value by the modifier value) to determine the modified error value. Alternatively, the computing system 120 may simply access a look-up table(s) stored within its memory device(s) 136 and determine the corresponding modifier error value from the accessed table based on the current actual error value.

In several embodiments, at (208), the computing system 120 may determine the modified error value based on the actual error value. That is, the modified error value (or the modifier value used to determine the modified error value) may be determined based on the value (i.e., the magnitude and direction) of the actual error value. More specifically, when certain actual error values are present, the implement 22 may be at an angle/orientation that is close to dumping the material within/on the implement onto the driving surface. However, some of these actual error values may be sufficiently small that the system 100 would respond slowly to them. That is, if such actual error values were used, the system 100 would control the tilt actuators 36 such that the tilt actuators 26 slowly adjust the angle of the implement 22 to avoid overshooting the selected angle. Thus, in such instances, if such actual error values were used to control the tilt actuators 36, further raising or lowering of the implement 22 could result in the implement 22 dumping its contents before the angle of the implement 22 is able to be adjusted to the selected angle. In this respect, the modified error value or the associated modifier values may be much greater in relation to the corresponding actual error values when the actual error values are within a certain range.

Figure 4:
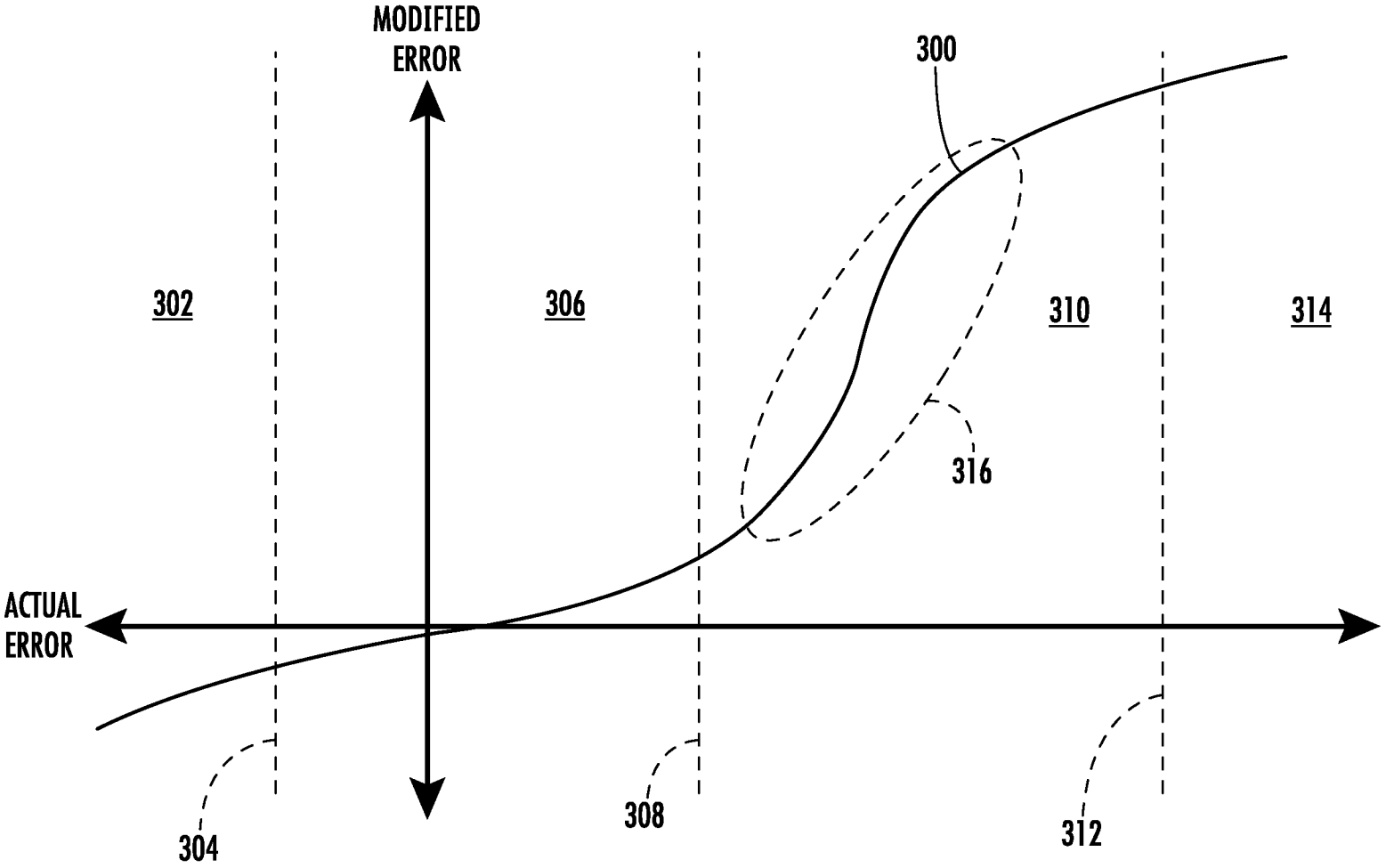
FIG. 4 illustrates a graphical view of an example dataset charting the actual error associated with the orientation of an implement of a work vehicle implement position relative to the modified error associated with the orientation of an implement in accordance with aspects of the present subject matter.

FIG. 4 illustrates a graphical view of an example dataset charting the actual error values (plotted on the horizontal axis) relative to the modified error values (plotted on the vertical axis). More specifically, in FIG. 4, the actual error value is zero at the vertical axis (i.e., the origin). As such, the actual error values to the left of the vertical axis are negative, thereby indicating that the implement 32 is dumped below the selected angle. Furthermore, the actual error values to the right of the vertical axis are positive, thereby indicating that the implement 22 is rolled back farther than the selected angle. Similarly, modified error values below the horizontal axis are negative and the modified error values above the horizontal axis are positive. In general, the modified error values (indicated by the line 300) vary based on the actual error values. More specifically, the dataset is broken up into four error zones, namely a first error zone 302 having actual error values less than a first actual error value (indicated by dashed line 304), a second error zone 306 having actual error values between the first actual error value 304 and a second actual error value (indicated by dashed line 308), a third error zone 310 having actual error values between the second actual error value 308 and a third actual error value (indicated by dashed line 312), and a fourth error zone 314 having actual error values greater than the fourth actual error value 312.

In the first and fourth zones 302, 314, the actual error values are large negative and positive error values, respectively. Specifically, when the actual error is in the first zone 302, the implement 22 may need to be rolled back to return the implement 22 to the selected angle. Conversely, when the actual error is in the fourth zone 304, the implement 22 may need to be dumped forward to return the implement 22 to the selected angle. Given the large errors associated with the first and fourth zones 302, 314, it is generally undesirable for the implement 22 to be in one of these zones 302, 314. As such, in these zones 302, 314, the modified error values vary linearly with the actual error values.

Furthermore, in the second zone 306, the actual error values are small positive and negative values. In this zone 306, the modified error values generally increase from the first actual error value 304 to the second actual error value 308. For example, as shown in FIG. 4, the modified error values generally increase linearly from the first actual error value 304 to the second actual error value 308. Thus, the modifier value may generally be a constant value in the second zone 306.

Moreover, in the third zone 310, the actual error values are greater than the small values in the second zone 306, but smaller than the large values in the fourth zone 314. In this respect, the third zone 310 may correspond to the range of actual error values at which continued vertical movement of the implement 22 could result in the implement 22 rolling back farther significantly beyond the selected angle. As shown, in the third zone 310, the modified error values and the associated modifier values generally increase rapidly from the second actual error value 308 to the third actual error value 312. For example, as shown in FIG. 4, the modified error values and the associated modifier values generally increase nonlinearly from the second actual error value 308 to the third actual error value 312. Thus, the modifier values may vary across the second zone 306. Moreover, the modifier values may be generally be greater in the third zone 310 than in the second zone 306.

The nonlinear increase in the modified error values within the third zone 306 may allow the system 100 to handle both light and heavy loads placed on the implement 22 better than conventional systems. More specifically, when a heavy load is placed on the implement 22, the weight of the load generally results in the actual error being within the first or second zones 302, 306. Conversely, when a light load (or no load) is placed on the implement 22, the actual error is generally within the third or fourth zones 310, 314. In such instances, the reduced weight on the implement 22 when the actual error is in the third zone 310 may result in the implement 22 rolling back significantly farther than the selected angle (e.g., well into the fourth zone 314) with continued vertical movement of the implement 22. As such, the nonlinear increase in the modified error values in the third zone 306 provides a larger and quicker system response when the actual error is within the third zone 310 to compensate for the reduced weight acting on the implement 22.

Additionally, by determining a modified error value corresponding to each determined actual error value, the computing system 120 may generate a modified error signal including a plurality of modified error values. As such, in some embodiments, at (208), the computing system 120 may be configured to smooth at least a portion of the modified error signal using one or more filters. Specifically, the computing system 120 may smooth out portions of the modified error signal having modified error values within a predetermined range. For example, the computing system 120 may smooth out portions of the modified error signal corresponding the nonlinear portions (indicated by dashed circle 316) of the third error zone 310 shown in FIG. 4. However, in alternative embodiments, the computing system 120 may use a filter to smooth any other suitable portions of the modified error signal.

The computing system 120 may be configured to use any suitable filter(s) to smooth the modified error signal. For example, in some embodiments, the computing system 120 may use an infinite impulse response (IIR) filter. In other embodiments, the computing system 120 may use a finite impulse response (FIR) filter.

In addition, as shown in FIG. 3, at (210), the method 200 may include controlling, with the computing system, the operation of a tilt actuator of the work vehicle to adjust the angle of the implement relative to the driving surface based on the modified error value. Specifically, in several embodiments, the computing system 120 may control the operation of the valve 118 based on modified error values such that the tilt actuators 36 adjust the angle of the implement 22 relative to the driving surface from its current angle to the selected angle. As mentioned above, the use of the modified error values increases the responsiveness of the system 100, thereby reducing the risk of the material within/on the implement 22 from falling out/off of the implement 22 as the implement 22 is further raised or lowered.

It is to be understood that the steps of the method 200 are performed by the computing system 120 upon loading and executing software code or instructions which are tangibly stored on a tangible computer readable medium, such as on a magnetic medium, e.g., a computer hard drive, an optical medium, e.g., an optical disc, solid-state memory, e.g., flash memory, or other storage media known in the art. Thus, any of the functionality performed by the computing system 120 described herein, such as the method 200, is implemented in software code or instructions which are tangibly stored on a tangible computer readable medium. The computing system 120 loads the software code or instructions via a direct interface with the computer readable medium or via a wired and/or wireless network. Upon loading and executing such software code or instructions by the computing system 120, the computing system 120 may perform any of the functionality of the computing system 120 described herein, including any steps of the method 200 described herein.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a controller.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

The invention claimed is:

1. A system for controlling implement orientation of a work vehicle, the system comprising:
- a vehicle chassis;
- a loader arm pivotably coupled to the vehicle chassis;
- an implement pivotably coupled to the loader arm;
- a lift actuator coupled between the loader arm and the vehicle chassis, the lift actuator configured to adjust a vertical position of the implement relative to a driving surface;
- a tilt actuator coupled between the implement and the loader arm, the tilt actuator configured to adjust an angle of the implement relative to the driving surface;
- a sensor configured to capture data indicative of the angle of the implement relative to the driving surface; and
- a computing system communicatively coupled to the sensor, the computing system configured to:
- control an operation of the lift actuator such that the implement is moved from a first vertical position relative to the driving surface to a second vertical position relative to the driving surface;
- monitor the angle of the implement relative to the driving surface based on the data captured by the sensor as the implement is moved from the first vertical position to the second vertical position;
- determine an actual error value between the monitored angle and a selected angle of the implement;
- determine a modified error value that is different than the actual error value based on the actual error value; and
- control an operation of the tilt actuator to adjust the angle of the implement relative to the driving surface based on the modified error value.

2. The system of claim 1, wherein, when determining the modified error value, the computing system is further configured to:
- determine a modifier value for the actual error value based on the actual error value; and
- apply the determined modifier value to the actual error value to determine the modified error value.

3. The system of claim 2, wherein the modifier value is smaller when the actual error value is within a first error zone extending from zero to a first error value than when the actual error value is within a second error zone extending from the first error value to a second error value.

4. The system of claim 3, wherein the modifier value increases as the actual error value increases from the first error value to the second error value.

5. The system of claim 4, wherein the modifier value increases nonlinearly as the actual error value increases from the first error value to the second error value.

6. The system of claim 1, wherein, when determining the modified error value, the computing system is configured to:
- generate a modified error signal including a plurality of modified error values; and
- smooth the modified error signal using a filter.

7. The system of claim 6, wherein, when determining the modified error value, the computing system is further configured to smooth one or more portions of the modified error signal having modified error values within a predetermined range using the filter.

8. The system of claim 6, wherein the filter is an infinite impulse response filter.

9. The system of claim 6, wherein the filter is a finite impulse response filter.

10. The system of claim 1, wherein, when determining the modified error value, the computing system is configured to:

access a stored look-up table; and use the look-up table to determine the modified error values based on the actual error value.

11. A method for controlling implement orientation of a work vehicle, the work vehicle including a lift actuator configured to adjust a vertical position of an implement of the work vehicle relative to a driving surface, the work vehicle further including a tilt actuator configured to adjust an angle of the implement relative to the driving surface, the method comprising:

controlling, with a computing system, an operation of the lift actuator such that the implement is moved from a first vertical position relative to the driving surface to a second vertical position relative to the driving surface;

monitoring, with the computing system, the angle of the implement relative to the driving surface based on received sensor data as the implement is moved from the first vertical position to the second vertical position;

determining, with the computing system, an actual error value between the monitored angle and a selected angle of the implement;

determining, with the computing system, a modified error value that is different than the actual error value based on the actual error value; and controlling, with the computing system, an operation of the tilt actuator to adjust the angle of the implement relative to the driving surface based on the modified error value.

12. The method of claim 11, wherein determining the modified error value further comprises:

determining, with the computing system, a modifier value for the actual error value based on the actual error value; and applying, with the computing system, the determined modifier value to the actual error value to determine the modified error value.

13. The method of claim 12, wherein the modifier value is smaller when the actual error value is within a first error zone extending from zero to a first error value than when the actual error value is within a second error zone extending from the first error value to a second error value.

14. The method of claim 13, wherein the modifier value increases as the actual error value increases from the first error value to the second error value.

15. The method of claim 14, wherein the modifier value increases nonlinearly as the actual error value increases from the first error value to the second error value.

16. The method of claim 11, wherein determining the modified error value comprises:

generating, with the computing system, a modified error signal including a plurality of modified error values; and smoothing, with the computing system, the modified error signal using a filter.

17. The method of claim 16, wherein determining the modified error value further comprises:

smoothing, with the computing system, one or more portions of the modified error signal having modified error values within a predetermined range using the filter.

18. The method of claim 11, wherein determining the modified error value further comprises:

accessing, with the computing system a stored look-up table; and using, with the computing system, the look-up table to determine the modified error values based on the actual error value.

* * * * *